US010024021B2

(12) United States Patent
Corbett

(10) Patent No.: US 10,024,021 B2
(45) Date of Patent: Jul. 17, 2018

(54) ANCHORING SYSTEM

(71) Applicant: Daniel I. Corbett, Legal (CA)

(72) Inventor: Daniel I. Corbett, Legal (CA)

( * ) Notice: Subject to any disclaimer, the term of this patent is extended or adjusted under 35 U.S.C. 154(b) by 0 days.

(21) Appl. No.: 15/429,768

(22) Filed: Feb. 10, 2017

(65) Prior Publication Data

US 2017/0233974 A1 Aug. 17, 2017

Related U.S. Application Data

(60) Provisional application No. 62/294,290, filed on Feb. 11, 2016.

(51) Int. Cl.
*E02D 7/20* (2006.01)
*E02D 5/24* (2006.01)

(52) U.S. Cl.
CPC ..... *E02D 7/20* (2013.01); *E02D 5/24* (2013.01); *E02D 2250/0053* (2013.01); *E02D 2250/0092* (2013.01)

(58) Field of Classification Search
CPC .... E02D 7/20; E02D 7/28; E02D 5/24; E02D 2250/0053; E02D 2250/0092; B63B 21/27
USPC .... 405/224, 224.1, 225, 227, 231, 232, 244, 405/249; 114/296
See application file for complete search history.

(56) References Cited

U.S. PATENT DOCUMENTS 4,405,262 A * 9/1983 Nagashima ..... E02D 5/56 248/354.2
4,720,214 A * 1/1988 Brasted ..... E02B 17/00 405/224
4,733,993 A * 3/1988 Andreasson ..... B63B 21/26 114/296
4,830,541 A 5/1989 Shatto
5,039,256 A * 8/1991 Gagliano ..... E02D 5/30 405/229
6,318,933 B1 * 11/2001 De Medeiros, Jr. .. B63B 21/502 405/223.1
6,719,496 B1 4/2004 Von Eberstein
2003/0029620 A1 * 2/2003 Strand ..... E21B 7/12 166/367
2011/0274503 A1 * 11/2011 Beck ..... E02D 27/52 405/224
2012/0003048 A1 * 1/2012 Hosoy ..... B63B 21/27 405/172
2012/0024535 A1 2/2012 Lieske
2012/0195691 A1 * 8/2012 Dolly ..... E02D 5/72 405/232

(Continued)

FOREIGN PATENT DOCUMENTS

WO WO 2015/054766 * 4/2015 ..... E02D 23/16

*Primary Examiner* — Carib A Oquendo
(74) *Attorney, Agent, or Firm* — Craig J. Lervick; Larkin Hoffman Daly & Lindgren, Ltd.

(57) ABSTRACT

An anchoring system using hollow piles connected with a cap, the hollow piles open at the top and closed at the bottom. A skirt extends from the cap. In use, the anchoring system is lowered to an ocean floor and a suction element removes water and ocean floor material from under the cap to lower the anchoring system into the ocean floor. Flexible walls at closed ends of the hollow piles may provide pressure differentials separating the undersea pressure to which the interiors of the hollow piles are exposed from air chambers at the closed ends of the piles at substantially lower pressures.

17 Claims, 7 Drawing Sheets

(56) References Cited

U.S. PATENT DOCUMENTS

2012/0230773 A1* 9/2012 Foo ..... E02B 17/021
405/224
2013/0243532 A1* 9/2013 Lynderup ..... E02B 17/02
405/232
2013/0302096 A1* 11/2013 Rodriguez Tsouroukdissian
..... E02D 5/22
405/225
2015/0259044 A1* 9/2015 Amate Lopez ..... B63B 21/502
114/265

* cited by examiner

ANCHORING SYSTEM

TECHNICAL FIELD

Anchoring systems

BACKGROUND

There is a need for anchoring systems to provide anchoring in soft ocean floors. A variety of tools are known, some of which rely upon suction to hold an anchor in the sea floor, for example as disclosed in US publication no. 2012/0024535.

SUMMARY

There is provided a novel anchoring system having plural piles, each pile defining a longitudinal channel, each longitudinal channel having an open end and a closed end opposite to the open end, a connecting structure maintaining the plural piles in rigid relation to one another, and each pile of the plural piles extending from the connecting structure at least in a first direction, the longitudinal channels extending in the first direction from the respective open ends to the respective closed ends.

In various embodiments, there may be included any one or more of the following features: the connecting structure may comprise a cap. There may be a skirt extending in the first direction from the cap, for example along the full length of the skirt. There may be a suction element and a suction flow channel through the cap defined by the suction element or defined by the cap and connected to the suction element. There may be an additional flow channel through the cap and a valve controlling flow through the additional flow channel. There may be a suspension element connected to the connecting structure. There may be respective walls at the closed ends of the longitudinal flow channels, the flexible walls comprising a material selected to withstand undersea pressure, and each flexible wall separating the respective longitudinal flow channel from a respective air chamber to maintain a pressure differential in use of the anchoring system.

There is also provided a ballasting unit having a housing open at a first end, a flexible wall separating the first end of the housing from a second end to define an air chamber at the second end, the flexible wall comprising a material selected to withstand undersea pressure, and to maintain a pressure differential in use of the ballasting unit.

These and other aspects of the device and method are set out in the claims, which are incorporated here by reference.

BRIEF DESCRIPTION OF THE FIGURES

Embodiments will now be described with reference to the figures, in which like reference characters denote like elements, by way of example, and in which.

DETAILED DESCRIPTION

Figure 1:
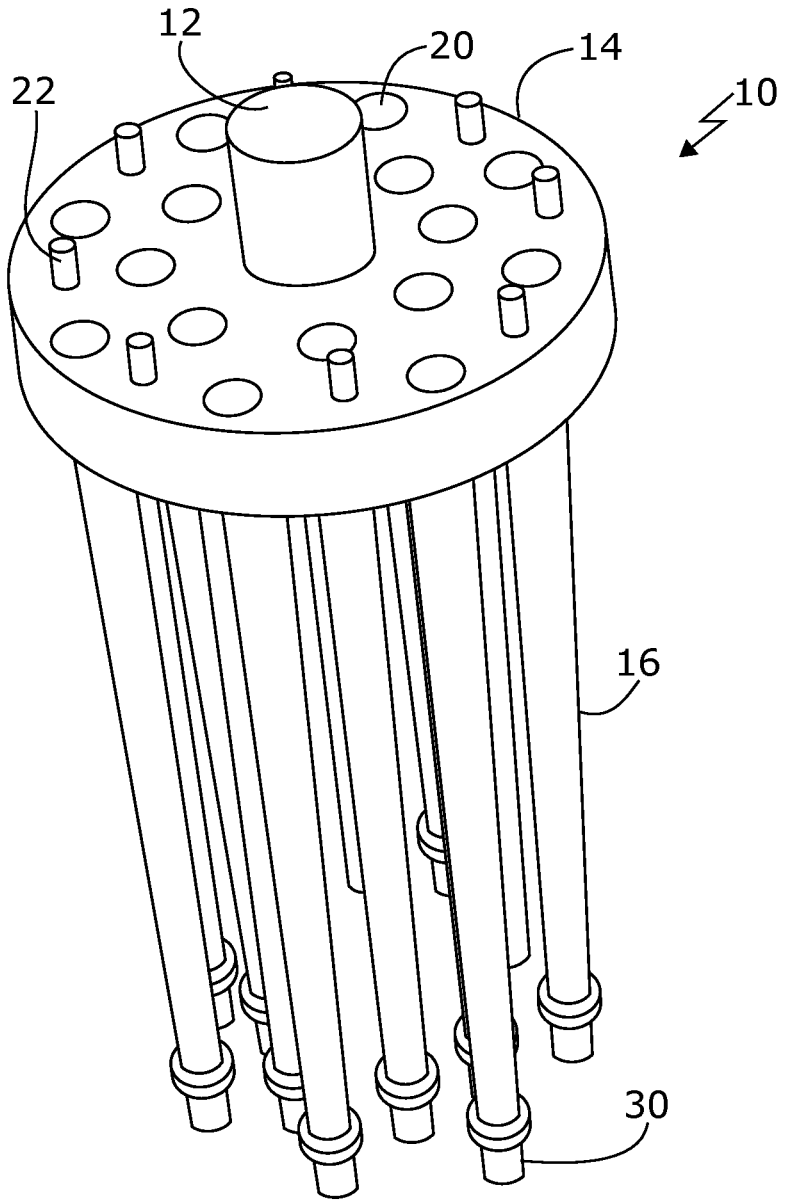
FIG. 1 is a perspective view of an anchoring system.

As shown in FIGS. 1-4, an anchoring system 10 comprises a tube 12 from which the anchoring system may be suspended to deploy and/or retrieve the anchoring system. The tube 12 also may provide suction to assist in sinking the anchoring system into the seafloor. These functions could also be provided by separate elements, for example a suspension element to deploy and retrieve the anchoring system and a suction element. The tube here is both a suspension element and a suction element. Tube 12 connects to a connecting structure for maintaining piles 16 in rigid relation to one another, the connecting structure here being a cap formed as a plate 14. Hollow piles 16 extend downward from plate 14, the piles being hollow in that they define longitudinal channels. Although tube 12 is shown in the figures as not extending below plate 14, in other embodiments it may do so, for example the bottom of piles 16, or to the level of the bottom of skirt 18 in embodiments having a skirt 18. Tube 12 defines a flow channel through the cap or connects to a flow channel defined by the cap. The longitudinal channels of the piles shown are closed at the bottom and open at the top, with openings 20 through the plate connecting to the longitudinal channels defined by the piles 16. Valves 22 controlling flow through additional flow channels through the cap may be used to remove water or mud from under the top plate or to insert another material such as barite to displace the mud. Ballasting units 30 are attached to the ends of piles 16 and form the closed ends of the longitudinal channels. Although not shown in FIG. 1 and FIG. 4, a skirt 18 may be present as in FIGS. 2 and 3, having any suitable length, preferably to the full length of the piles 16.

Figure 2:
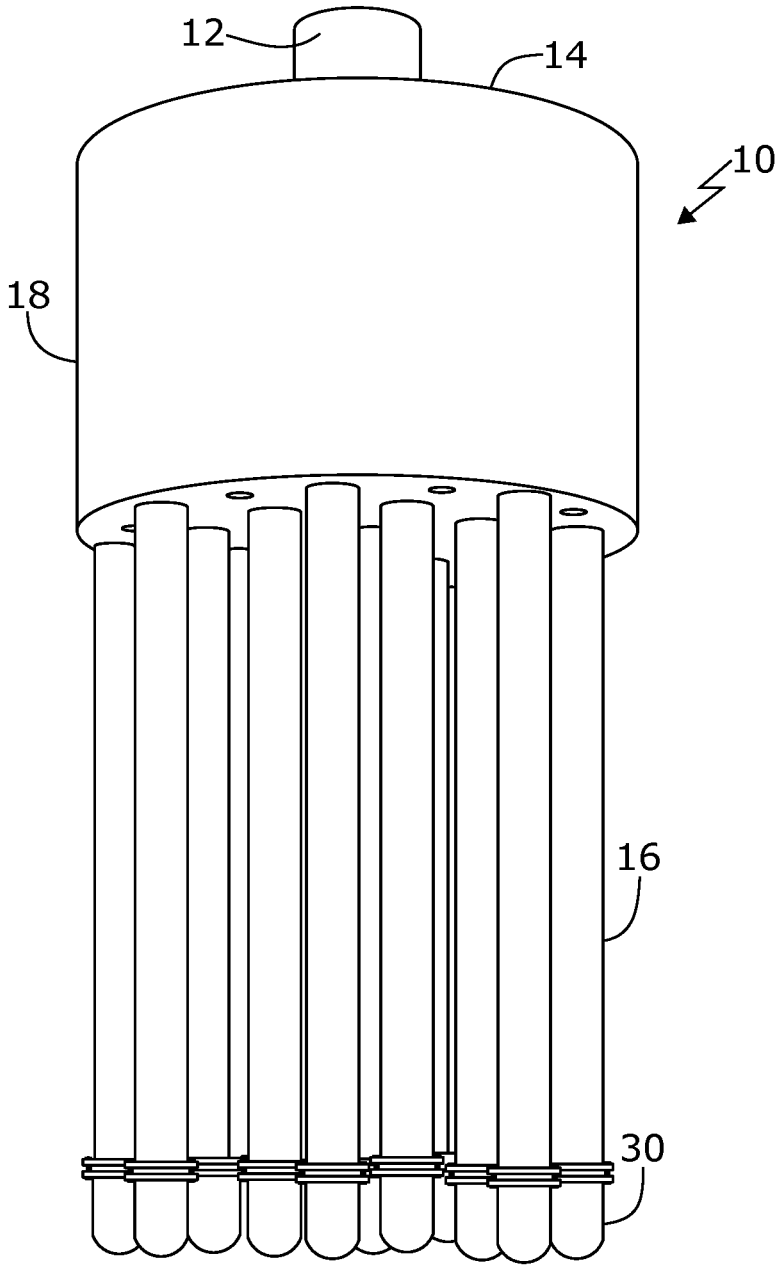
FIG. 2 is a side perspective view of an anchoring system with a skirt about the upper part of the anchoring system.
Figure 3:
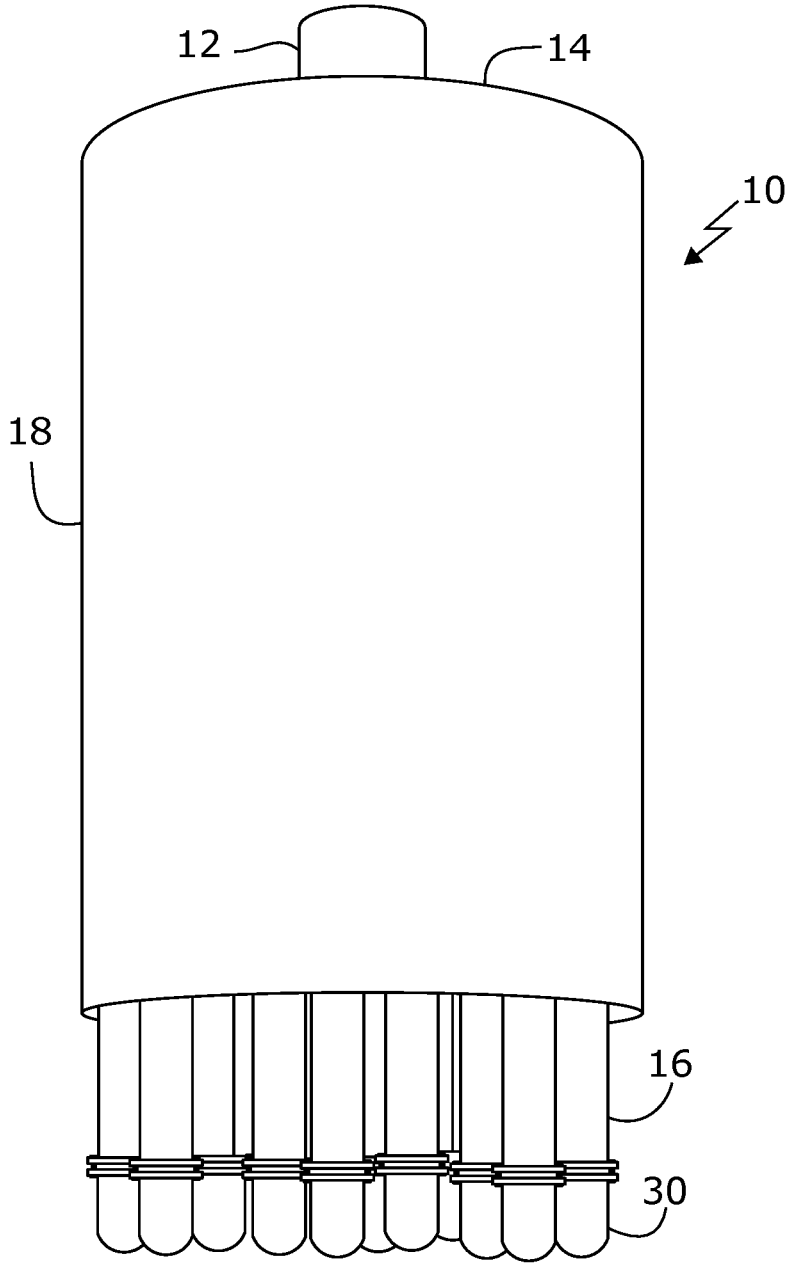
FIG. 3 is a side perspective view of an anchoring system with a skirt extending further than the skirt shown in FIG. 2.

FIGS. 2 and 3 show further embodiments of anchoring system 10 having a skirt 18. In FIG. 2 a skirt 18 extends downward from the periphery of plate 14. In FIG. 3 skirt 18 is shown in as extending further than in FIG. 2 though in practice all skirts may be the full length of the device.

Figure 4:
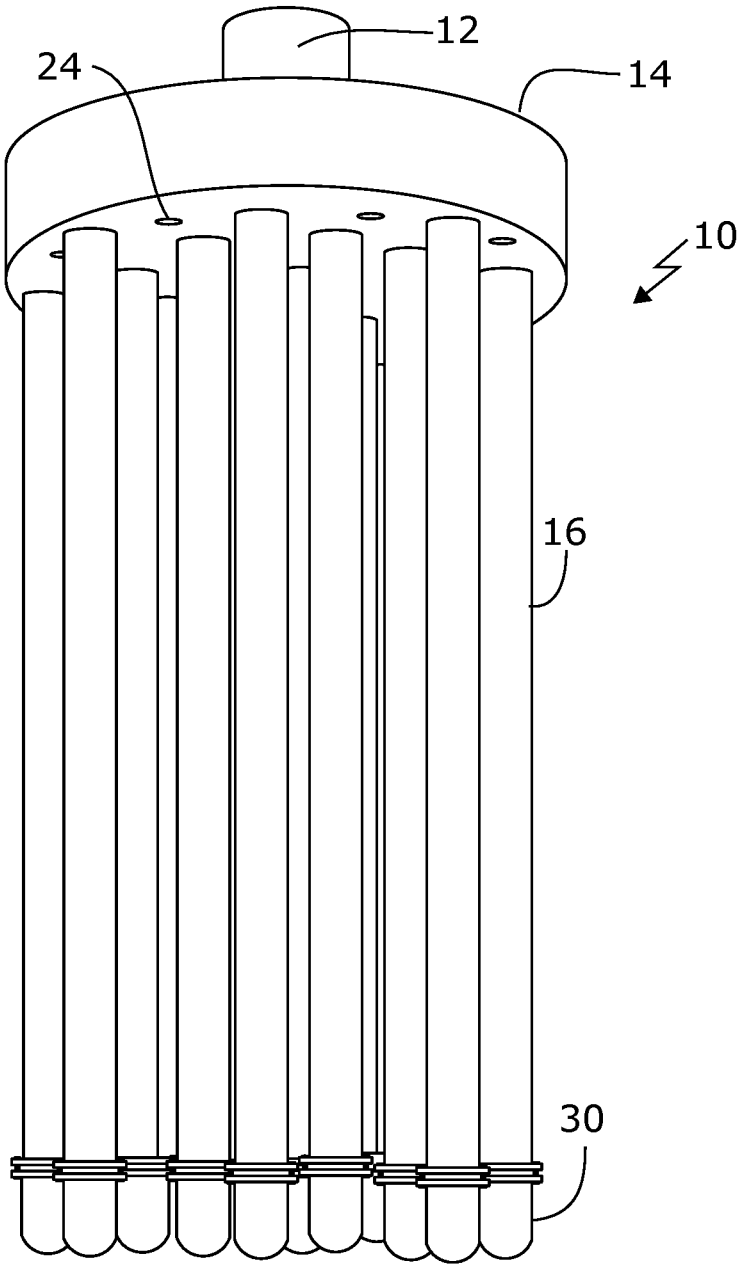
FIG. 4 is a side perspective view of the anchoring system.

FIG. 4 shows the embodiment of FIG. 1 from a side perspective view. Additional flow channels 24 are shown in top plate 14 connecting to valves 22 which control flow through the additional flow channels.

In use, it is contemplated that the disclosed anchoring system will be lowered to an ocean floor using tube 12 or another suspension element. Tube 12 or another suction element may be used to suck water and ocean floor material out from under the cap 14. The suction flow may be reversible or an additional downward flow element (not shown) may be provided to stir up ocean floor material to be sucked out. An oscillating shaft (not shown) may also be provided to stir up ocean floor material. Valves 22 may be used to syphon off water or to pump in barite to displace ocean floor material with something heavier. The actions described for sinking the anchoring system into the ocean floor may be carried out until the anchoring system is sunk to a desired level, which may depending on the application be when the cap is flush with the ocean floor.

Figure 5:
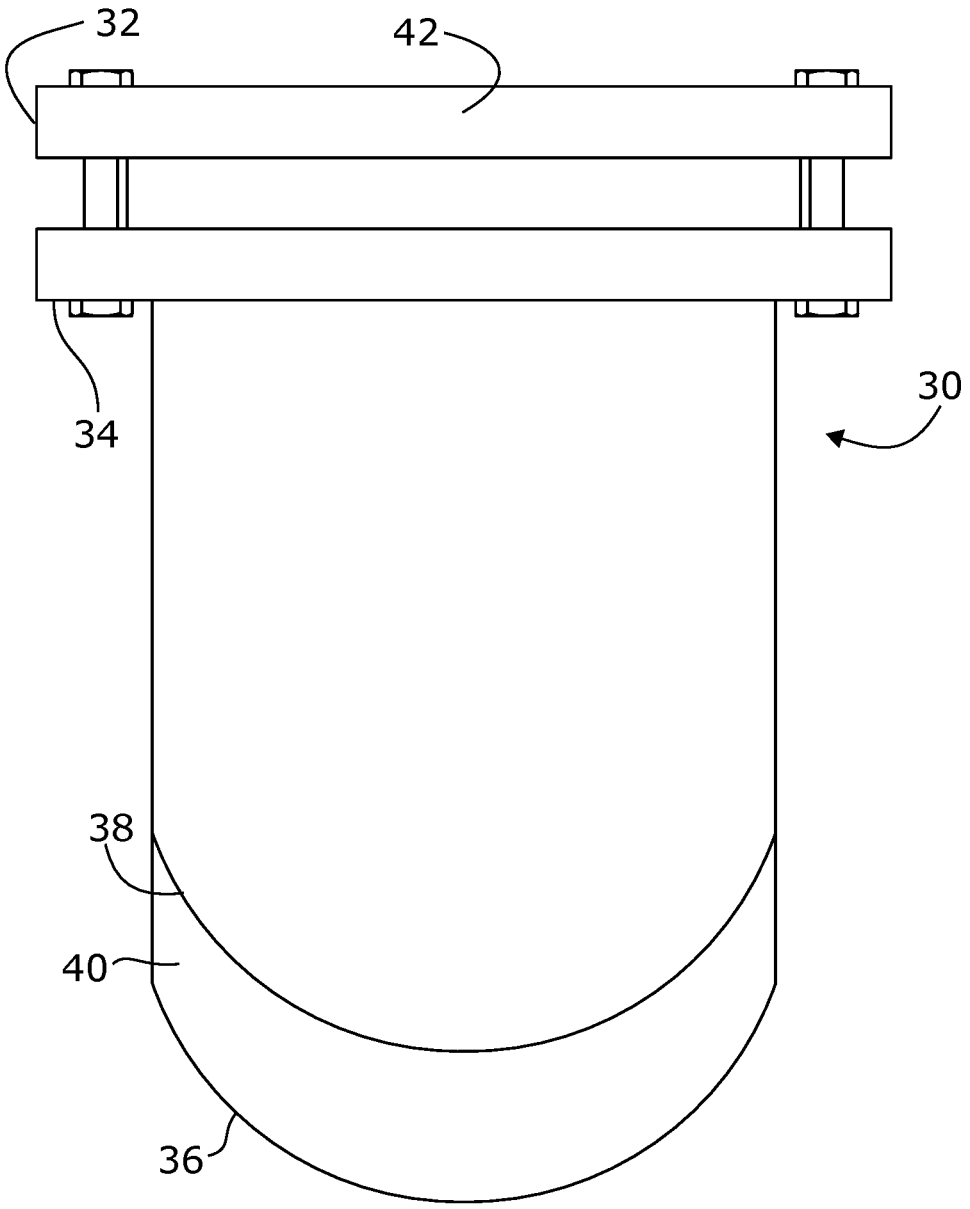
FIG. 5 is a side view of a ballasting unit.

FIG. 5 shows an embodiment of a ballasting unit 30 suitable for placement at the ends of piles 16. Referring to FIG. 5, upper pipe flange 32 and lower pipe flange 34 facilitate the connection of unit 30 to the ends of piles 16. Ballasting unit 30 comprises an outer housing 36. A flexible wall 38 separates an air chamber 40 within the housing from seawater admitted through opening 42, here through the upper and lower pipe flanges. The flexible wall in the embodiment shown takes the form of a neoprene cylinder. When ballasting unit 30 is used at ends of piles 16 as shown in FIGS. 1-4, a rounded housing is preferred to aid penetration of the piles into mud.

The flexible wall of the ballasting unit is selected to be of a stiffness such that it will be moved by the pressures encountered when deployed, but will not be sufficiently moved to fully collapse the air chamber at the intended depth of use. The inventor believes that the pressure of the overlying water on the flexible wall of the ballasting unit will act to resist changes in attitude of the anchoring system, when the ballasting unit is placed as shown at the bottom of piles 16, and exposed to the overlying water through the longitudinal channels of the piles.

The designs provided are contemplated to serve as a mooring system in areas of the ocean where poor anchorage or holding ground exists, for example sandy or silt ocean floor. The Gulf of Mexico is one example of an ocean area believed to be suitable. It is believed that this design can be used as a ballasting system in emergency procedures where a blowout has occurred in a Deep-Sea oil field. A neoprene canister suitable for forming a flexible wall 38 as shown has been tested and pressured to over 20,000 psi with no damage. The dimensions and the general shape of the existing unit have been constructed for test purposes only. A working unit can be constructed to conform to the requirements of a subsea structure for the purposes of ballasting or anchoring. Some examples include: hydraulic valve systems, drilling systems or excavation equipment.

Figure 6:
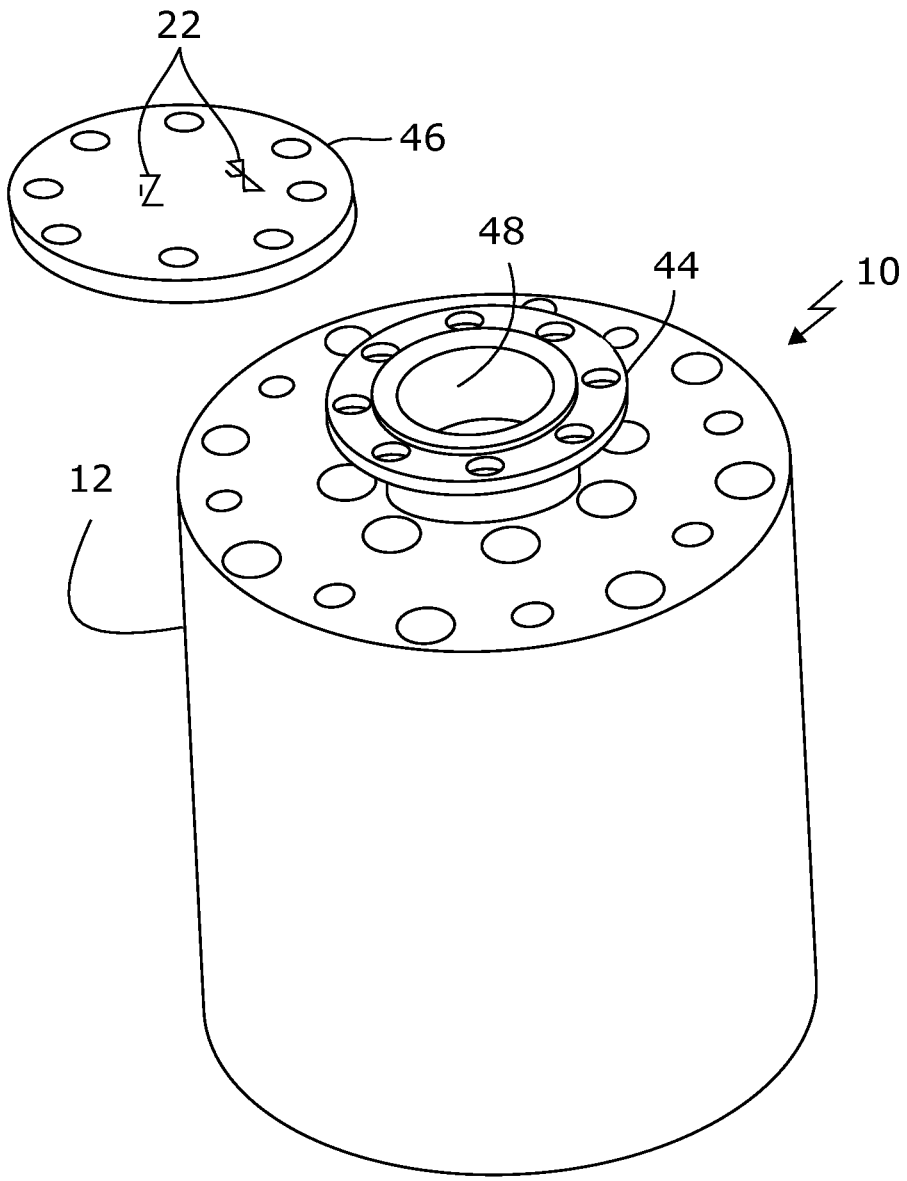
FIG. 6 shows an anchoring system with a flange connection for connecting for example to a pump to pump fluid from the unit, and a flange cover.
Figure 7:
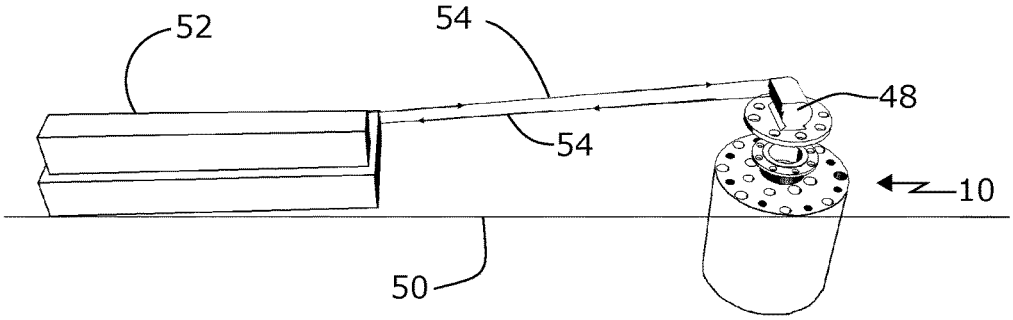
FIG. 7 shows an anchoring system with pump and hydraulics on a bed or floor of a body of water.

FIG. 6 depicts a complete anchoring system 10, with the exception of any reinforcement which may be required. A pipe flange 44 is secured to the end of tube 12, and a flange cover 46 may be secured to the top of pipe flange 44 when no other equipment is attached to the pipe flange 44. The actual size of the flange 44 would be determined as field conditions require. The particular use being made of the mooring unit would determine whether or not a flange cover 46 would be required.

The purpose of the pipe flange 44 is to accommodate a pump 48 with the capacity to pump heavy mud, silt, or sand. As already stated, the excavation of the mud, silt, or sand would in turn cause the mooring unit to become completely submerged in the ocean substrate. At the point where the unit would be submerged to its intended depth, in the ocean floor, the pump 48 would be removed and in some applications of the mooring unit, the flange cover 46 would be installed. The pump 48 may form part of a suction element by being secured to the pipe flange 44.

When deployed exclusively as a mooring device, the center access tube 12 of the anchoring system 10 is fitted with a flange cover 46 after being submerged in the ocean substrate 50. The flange cover 46 may be fitted with two valves 22, a check valve, and a gate valve. The gate valve allows dense mud to be pumped into the center tube while the check valve allows water to be forced out of the capped access tube 12 as it fills with the injected mud.

When deployed to include a pump 48, the anchoring system 10 may be connected by hydraulic lines 54 to a hydraulic manifold system 52 placed on a support bed or pod on a bed, bottom or floor 50 of a body of water, such as a sea, ocean, river or lake. The hydraulic manifold system 52 may be charged from a single source located onboard a surface vessel. Hydraulic fluid may then be directed under pressure to the anchoring system 10 to a point where it would open or close an individual valve 22 as required or to power the motor of the pump 48. The hydraulic manifold system 52 may be situated either on board a surface vessel or may be placed on the seafloor whichever arrangement best suited the field conditions and the particular use being made of the mooring unit.

The hydraulic mud pump 48 and valves 22 may be employed in the course of submerging the unit in the seafloor and injecting mud as required. Once the anchor is in place the hydraulic system and pump would not be required again until the process is reversed and water is pumped in to remove and retrieve the anchor unit.

The anchoring system 10 may be fitted with hydraulic knife-gate valves having the capacity to sever drill pipe.

The gate valves 22 may be operated mechanically through the use of Remotely Operated Vehicles. The pump and hydraulics are conventional and need not be further described here.

Immaterial modifications may be made to the embodiments described here without departing from what is covered by the claims.

In the claims, the word "comprising" is used in its inclusive sense and does not exclude other elements being present. The indefinite articles "a" and "an" before a claim feature do not exclude more than one of the feature being present. Each one of the individual features described here may be used in one or more embodiments and is not, by virtue only of being described here, to be construed as essential to all embodiments as defined by the claims.

The embodiments of the invention in which an exclusive property or privilege is claimed are defined as follows:

1. An anchoring system installed on a bed, floor or bottom of a body of water, the bed, floor or bottom of the body of water being formed of a bottom material, the anchoring system comprising:

a cap connected to a suction element, a suction flow channel through the cap being defined by the suction element or being defined by the cap and connected to the suction element;

plural piles extending from the cap at least in a downward direction;

a skirt extending in the downward direction from the cap around the piles to define a volume within the skirt and between the piles, the volume including a mud denser than the bottom material;

each pile defining a longitudinal channel, each longitudinal channel having an open end and a closed end opposite to the open end, the longitudinal channels extending in the downward direction from the respective open ends to the respective closed ends; and respective flexible walls at the closed ends of the longitudinal flow channels, the flexible walls comprising a material selected to withstand undersea pressure, and each flexible wall separating the respective longitudinal flow channel from a respective air chamber to maintain a pressure differential in use of the anchoring system.

2. The anchoring system of claim 1 in which the suction element comprises a pump.

3. The anchoring system of claim 2 in which the pump is connected to a hydraulic system.

4. The anchoring system of claim 3 further comprising an additional flow channel through the cap and a valve controlling flow through the additional flow channel.

5. The anchoring system of claim 4 further comprising a suspension element connected to the cap.

6. The anchoring system of claim 5 further comprising a suspension element connected to the cap.

7. The anchoring system of claim 1 further comprising an additional flow channel through the cap and a valve controlling flow through the additional flow channel.

8. The anchoring system of claim 7 further comprising a suspension element connected to the cap.

9. The anchoring system of claim 1 further comprising a suspension element connected to the cap.

10. The anchoring system of claim 1 in which the skirt extends a full length of the piles.

11. The anchoring system of claim 1 in which the mud comprises barite.

12. A method of installing an anchoring system on a bed, floor or bottom of a body of water, the bed, floor or bottom of the body of water being formed of a bottom material, the method comprising the steps of:

providing an anchoring system comprising a cap, plural piles extending from the cap at least in a downward direction, a skirt extending in the downward direction from the cap around the piles to define a volume within the skirt and between the piles, each pile defining a longitudinal channel, each longitudinal channel having an open end and a closed end opposite to the open end, the longitudinal channels extending in the downward direction from the respective open ends to the respective closed ends, respective flexible walls at the closed ends of the longitudinal flow channels, the flexible walls comprising a material selected to withstand undersea pressure, and each flexible wall separating the respective longitudinal flow channel from a respective air chamber to maintain a pressure differential in use of the anchoring system;

lowering the anchoring system to the bed, floor or bottom of the body of water;

providing suction through a suction flow channel through the cap; and supplying a mud denser than the bottom material into the volume within the skirt and between the piles, providing a flow path through the cap to allow water or bottom material to escape from the volume as the mud is supplied into the volume.

13. The method of claim 12 further comprising stopping the provision of the suction when the anchoring system reaches an intended depth.

14. The method of claim 13 in which the intended depth is a depth at which the cap is flush with the bed, floor or bottom of the body of water.

15. The method of claim 12 in which the flow path is provided via a check valve.

16. The method of claim 12 in which the suction flow channel is connected to an access tube that is capped before the step of supplying a mud denser than the bottom material into the volume within the skirt and between the piles.

17. The method of claim 12 in which the mud comprises barite.

* * * * *